US005731705A

United States Patent [19]

Guinn

[11] Patent Number: 5,731,705

[45] Date of Patent: Mar. 24, 1998

[54] ELECTROMAGNETIC LIFTING DEVICE

[76] Inventor: Burl H. Guinn, 3001 Greenline, Johnson City, Tenn. 37604

[21] Appl. No.: 751,261

[22] Filed: Nov. 18, 1996

Related U.S. Application Data

[63] Continuation-in-part of Ser. No. 634,273, Apr. 18, 1996.

[51] Int. Cl.[6] ..... B66C 1/04; E21B 31/06; H01F 7/20

[52] U.S. Cl. ..... 335/291; 414/606; 335/289

[58] Field of Search ..... 335/285–295; 294/65.5; 414/606, 619

[56] References Cited

U.S. PATENT DOCUMENTS

| | | | |
|---|---|---|---|
| 2,622,750 | 12/1952 | Ehlers | 414/619 |
| 3,596,967 | 8/1971 | Carter | 294/65.5 |
| 4,044,894 | 8/1977 | McDonald et al. | 214/100 |
| 4,323,329 | 4/1982 | Chlad | 414/737 |
| 4,478,152 | 10/1984 | Holley | 104/279 |
| 4,523,782 | 6/1985 | Marshall | 294/65.5 |
| 4,593,766 | 6/1986 | Gossard | 171/63 |

*Primary Examiner*—Cassandra C. Spyrou
*Assistant Examiner*—Raymond M. Barrera

[57] ABSTRACT

An electromagnetic pick-up device for use with a forklift or other vehicle having a power lifting mechanism thereon, wherein the device is adapted to be easily picked up by the lifting mechanism and is completely self-contained and electrically powered such that it can be transported and manipulated by the vehicle into tight areas, wherein electromagnets are pivotally, swingably mounted on the forward end of the device and are substantially positioned beyond the forward end, whereby the device is particularly suited for picking up difficult-to-handle metal pieces which normally present handling dangers, and which is adapted to be easily released from the vehicle without any need for disconnecting any electrical, hydraulic, or the like power transmitting equipment from the vehicle.

10 Claims, 4 Drawing Sheets

ELECTROMAGNETIC LIFTING DEVICE

This application is a continuation-in-part of application Ser. No. 08/634,273, filed Apr. 18, 1996, entitled ELECTROMAGNETIC LIFTING DEVICE, and now pending.

BACKGROUND OF INVENTION (a) Field of the Invention

This invention concerns a self-contained, electromagnetic pick-up unit which is especially useful for picking up hard-to-handle metal pieces and which is adapted to fit onto practically any lifting mechanism such as the tines of a fork-lift truck or the blade or front connector plate of a skidsteer or bulldozer or the like, whereby the unit is easily affixed to or removed from said lifting mechanism such that the principal utility of the lifting mechanism is not compromised.

All companies that routinely handle steel and its alloys are required to "burn" (torch-cut) or shear large sections into smaller pieces or "drops". The small, e.g., 2–2000 lbs. drops or pieces typically fall under the burning table or the end of the shear and are removed only when the accumulation becomes a problem.

In typical manufacturing plants, machine shops, metal stamping operations, heavy metal framing fabrication shops, and the like, the lifting and transport of heavy, cumbersome metal items such as irregularly shaped pieces, slabs, sheets, beams or the like, almost by necessity creates a dangerous situation for workers, whether the lifting is done by hand or machines. This condition is exacerbated by the difficult location of such items as, e.g., under worktables or under or on outwardly extending portions of loading docks, metal processing equipment, or the like where reaching out to grasp the item presents vision difficulties in regard to selecting the grasping site of the item such that it can be selectively lifted from an entangled pile of said items and selectively removed therefrom without dragging other unwanted items from the pile.

Heretofore, this removal has been done by hand and far too often the end result is a back, foot or hand injury. Because of the type of injury, i.e., sharp, dirty steel cuts or severe back muscle or other tissue damage, the injuries are slow healing. In this regard the average back injury in the U.S. adds in excess of $20,000 to overall production costs according to OSIER figures which includes replacement personnel and benefits costs. In studying ways to mitigate this problem, applicant has determined that no solution is presently available in the market place.

(b) Description of Related Art

Heretofore, various electromagnetic pick up devices have been provided on equipment such as fork lift trucks, hand operated carts, bulldozer type tractors or the like as shown in U.S. Pat. Nos.: 4,593,766; 2,622,750; 3,596,967; 4,044,894; 4,323,329; 4,523,782; and 4,478,152, however these electromagnetic units have either not been self-contained and require special electrical, mechanical or hydraulic devices or equipment mounted on the principal vehicle itself in order to provide the necessary electrical power, or have not been provided with magnet placements and mounting structures which lend the equipment to performing the tasks to which the present invention is directed, i.e., picking up scrap or other ofttimes heavy long beams from piles of scrap under tables or off of loading docks or the like.

OBJECTS OF THE INVENTION

Objects, therefore, of the present invention are: to provide an electromagnetic pick-up device which is completely self-contained, requiring no electrical or hydraulic lines, conduits or the like permanently connected to the forklift truck or other vehicle; to provide such a device which can be picked up, moved around to pick up metal, and then left at any desired location for storage or readiness, without the need for undoing any piping, tubing, electrical connections, clamps, bolts, brackets, tie-lines or the like requiring hand manipulation by the vehicle operator or by other workers; to provide such device which does not require an operator to handle heavy, sharp or otherwise dangerous metal pieces and which is extremely safe and easy to use; and to provide such device in a simple, relatively low cost, self-contained system wherein the electrical power generator means is comprised substantially of off-the-shelf and readily available components.

In pursuance of these objects, applicant has designed an electromagnetic device which can be readily picked up by a forklift or other vehicle and used to pick up in an extremely selective manner and transport metal items very safely and expediently. The device comprises a platform on which an independent electrical power supply, CDS controllers, rectifiers and other electrical and mechanical components are mounted. This power supply can operate a bank of powerful electromagnets, e.g., 9,000 lbs. capacity, the magnets being small enough in size to fit under a burning rig, shear, table or the like. The lift truck operator handles all controls, making it possible for one man to remove all metal drops and place them in their proper bins.

Because of the unique size and shape of the device, it will also handle pipe, tubing, random length stock and full size plate without the need for maneuvering the truck to the center of the workpiece. The metal moving operation can now become easy, fast, and safe. Upon completion of the task, the lift truck simply backs out of or away from the platform and continues in other conventional uses.

SUMMARY OF THE INVENTION

The above and other objects hereinafter appearing have been attained in accordance with the present invention through the discovery which is defined in its broad sense as a self-contained electromagnetic pick-up device for use particularly with a vehicle having powered lifting means, said device comprising platform means for supporting electrical and mechanical components of said device, said platform means having a forward section, a rear section, and opposite side portions, adaptor means on said rear section for engaging and being supported by said lifting means for being moved thru a lifting cycle thereby, electrical power means on said platform means, at least two electromagnet means substantially universally pivotally and swingably mounted on said platform means adjacent the forward end thereof by pivotal swingable mounting means, major portion of the electromagnet means extending beyond said forward end to allow pivotal swing motion of the electromagnet means, and electrical switch means, adapted to electrically connect or disconnect said power means from said electromagnet means whereby an operator can selectively control the energization of said electromagnet means.

In certain preferred embodiments:

(a) said adaptor means comprises a pair of elongated tubular members each being configured and dimensioned in cross-section for slidably receiving a tine of a forklift truck;

(b) said electromagnet means comprises one or more 115 volt D.C. electromagnets affixed to said forward section with their armature faces extending below the plane of said section;

(c) said switch means is provided with quick-disconnect means for providing for positioning said switch means within or adjacent to the operators compartment of a vehicle and for easy removal thereof from said compartment such as upon release of said pick-up device from said lifting means;

(d) said power means is positioned on said rear section of said platform means; and (e) said power means substantially comprises a 2.5 kw. 20 amp. propane fuel operated D.C. generator.

BRIEF DESCRIPTION OF THE DRAWINGS

The invention will be further understood from the following drawings and description of certain preferred embodiments of the invention, wherein.

DESCRIPTION OF PREFERRED EMBODIMENTS

Figure 1:
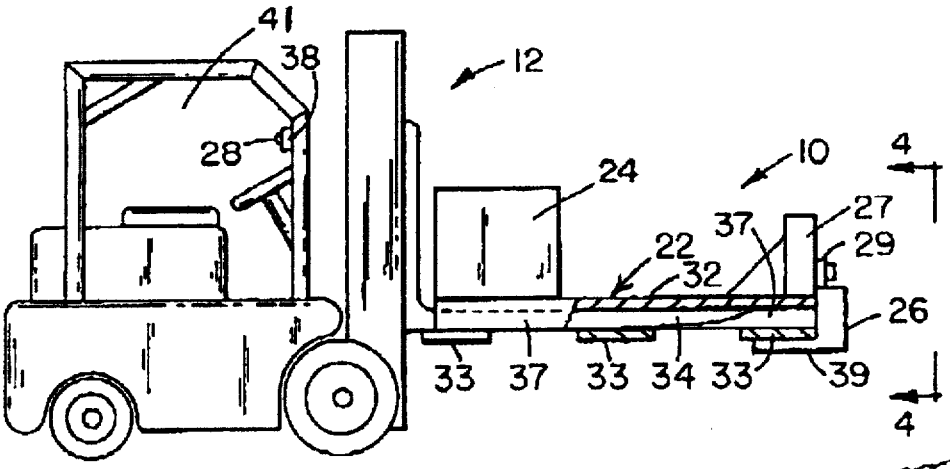
FIG. 1 is a side view of a forklift truck with the present device mounted on the tines thereof, and of the adaptor means with portions cross-sectioned for clarity.

Referring to the drawings and with particular reference to the claims hereof, the present invention comprises a self contained electromagnetic pick-up device generally designated 10 for use particularly with a motorized vehicle 12 having powered lifting means 14, said device comprising platform means 16 for supporting electrical and mechanical components of said device, said platform means having a forward section 18 and a rear section 20, adaptor means 22 on said rear section of said platform means for engaging and being supported by said lifting means for being moved thru a lifting cycle thereby, electrical power means 24 on said platform means, electromagnet means 26 substantially universally pivotally and swingably mounted on said platform means adjacent the forward end thereof by pivoted swingable mounting means 29 and having major portions extending beyond said forward end, and electrical switch means 28 adapted to electrically connect or disconnect said power means from said electromagnet means whereby an operator can selectively control the energization of said electromagnet means.

The vehicle with which the present device can be used can be of any type, i.e., motorized or hand movable and which has lifting capacity such as that of a forklift truck, skidsteer, bulldozer or other such bladed vehicle, or a large hand operated lift dollie or the like. Such vehicles are all provided with lift mechanisms such as tines, blades, bases or the like which offer structure for which the adaptor means of the present device can be structurally configured or tailored and on which the adaptor means and platform means can be readily mounted.

Figure 2:
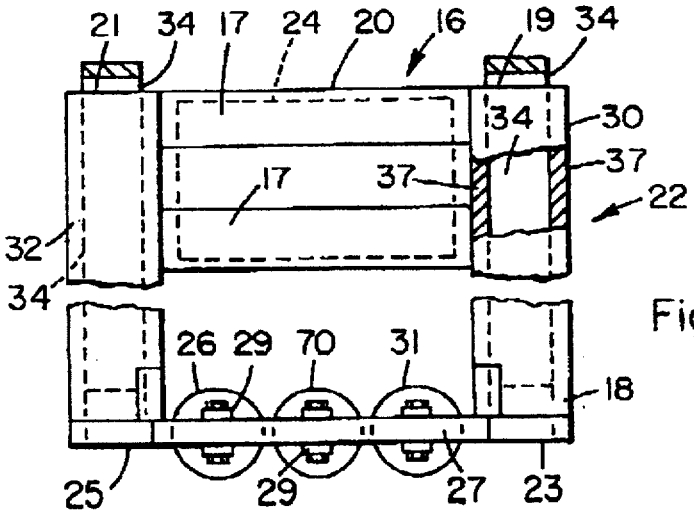
FIG. 2 is a top elevational view of the truck and device of FIG. 1 with the electrical power generator shown in dotted outline.

Referring to FIGS. 1 and 2 said adaptor means comprises a pair of elongated tubular members 30 and 32 each dimensioned in cross-section to slidably receive a tine 34 of a forklift truck. It is preferred that these members be sufficiently long as to extend beyond the ends of the tines such that the electromagnets can be presented to the metal workpieces without interference from the tines.

The platform means 16 can be of any convenient construction such as a metal sheet extending across the tines, or a framework such as cross-bars 17 welded at their ends to the members 30 and 32. These members may be totally tubular or may be of channel iron on steel 35 with plates such as 33 welded across the channel sides 37 at positions spaced longitudinally along the members to provide tubular segments for slidably receiving and retaining the tines.

In a highly preferred embodiment and with particular reference to FIGS. 13–16, the present device comprises a self-contained electromagnetic pick-up device for use particularly with a vehicle having power lifting means, said platform means 16 for supporting electrical and mechanical components of said device, said platform means having a forward section 18, a rear section 20, and a pair of opposing side portions 30, 32 each of which has a proximal end 19, 21 respectively adjacent said rear section 20 and a distal end 23, 25 respectively adjacent said forward section 18, adaptor means 22 on said rear section for engaging and being supported by said lifting means for being moved thru a lifting cycle thereby, electrical power means 24 on said platform means, at least two separate electromagnet means 26, 31 on said platform means, and electrical switch means 28 adapted to electrically connect or disconnect said power means from said electromagnet means whereby an operator can selectively control the energization of said electromagnet means, wherein at least two 26, 31 of said electromagnet means is each mounted on said platform means by separate pivotal, swingable mounting means each generally designated 29, each said mounting means comprising a first component 45, preferably a nut-type connecting link, affixed to a second component 47 at the distal end of a said side portion and a third component 51 affixed to an electromagnet means and providing generally universal pivot freedom to said electromagnet means as well as the freedom to swing towards the front, back and sides of components 47, i.e., about axis 49, wherein each said mounting means and its associated electromagnet means has a substantially coextensive and substantially vertical rest axis 49 passing thru said first 45, second 47 and third 51 components, wherein cooperating one or more first stop means 52, 54 and one or more second stop means 53, 55 are provided on said mounting means and spaced apart along said axis when said electromagnet means is in a hanging posture and extending generally laterally of said axis, whereby in use, one of said electromagnet means can assume a position elevated a short vertical distance higher above the normal horizontal plane 59 of the electromagnet means than the other electromagnet means to accommodate a limited workpiece tilt plane 60 of an angle $\alpha$ of up to about 35° with respect to said horizontal plane and having a lateral axis of rotation approximately at 61, and wherein at least a major portion of said at least two electromagnet means lies beyond the distal end of its associated side portion and is substantially unencumbered in its pivot and swing freedom by any portion of said platform means.

It is noted that plane 59 is established when the tines of the fork lift truck are in a horizontal plane. In this regard, rotation of the lift mechanism of the truck around lateral axis 61 or around longitudinal axis of rotation 62 (FIG. 10) in order to assist in placement of the magnets can be utilized without adversely affecting the pivot and swing freedom of the magnets in maximizing placement of the magnets against the workpiece.

Figure 7:
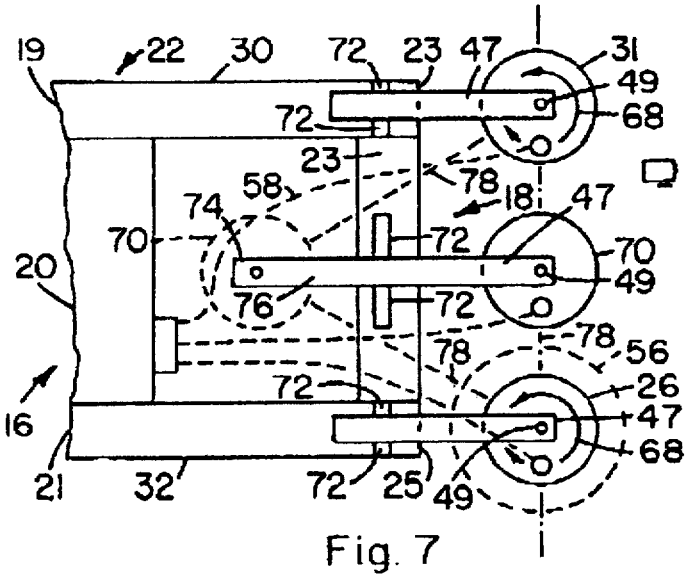
FIG. 7 is a top view of a three magnet embodiment of the present device taken along the line 7—7 of FIG. 6 in the direction of the arrows.

A typical swing action or freedom periphery allowed to the magnets by the present mounting structure is depicted generally by the dotted outline 56 in FIG. 7. This periphery will vary depending on the dimensions of aforesaid components and the clearances between the aforesaid stop means. The swing action or freedom is important in maximizing the versatility of the present device in being able to tip or slide its magnets across a workpiece into the most stable posture with respect to the workpiece prior to energizing the magnets whereby the flat contact surface 57 of the magnets can lie flat against the workpiece, thereby enhancing the magnet lift capacity.

The use of a single first component is shown, however, multiple links such as 45 may be used to comprise the first component means as long as they do not extend $\alpha$ to such as degree that long, unbalanced workpiece will not be picked up cleanly. In this regard, there only short workpieces are anticipated, a longer nut link 45 may be used, and when necessary for longer workpieces, the link may be changed to a shorter one simply by loosening nut 65 and replacing the link.

The electromagnet means 26 preferably comprises one or more 115 volt D.C. electromagnets each affixed to a bar 27 by pivotal, swingable mounting means 29 attached to the magnets and to the bar which is welded across the webs 40 of the channel steel 35 of members 30 and 32 at said forward section, with the armature faces 39 extending below the plane 36 of said tubular members 30 and 32. The number, strength and positioning of these magnets on the platform can be selected to achieve the desired lifting. Typical such magnets useful for the present invention are as described in *OHIO MAGNETICS, INC., LIFTING MAGNET SYSTEMS* catalog "OM-15370 November, 1994" at page 9 under "Models Operating On Standard D.C. Voltage", and in *O.S. WALKER COMPANY, INC.*, 1993 catalog entitled "WALKER SELF-CONTAINED LIFT MAGNETS" at page 5, the disclosures and descriptions of which are hereby incorporated herein by reference in their entirety.

The switch means 28 is preferably of a retractable reel type and provided with quick-disconnect means such as a permanent magnet 38 for conveniently positioning said switch means within or adjacent to the operators compartment 41 of a vehicle simply by placing said magnet against the compartment frame.

Figure 5:
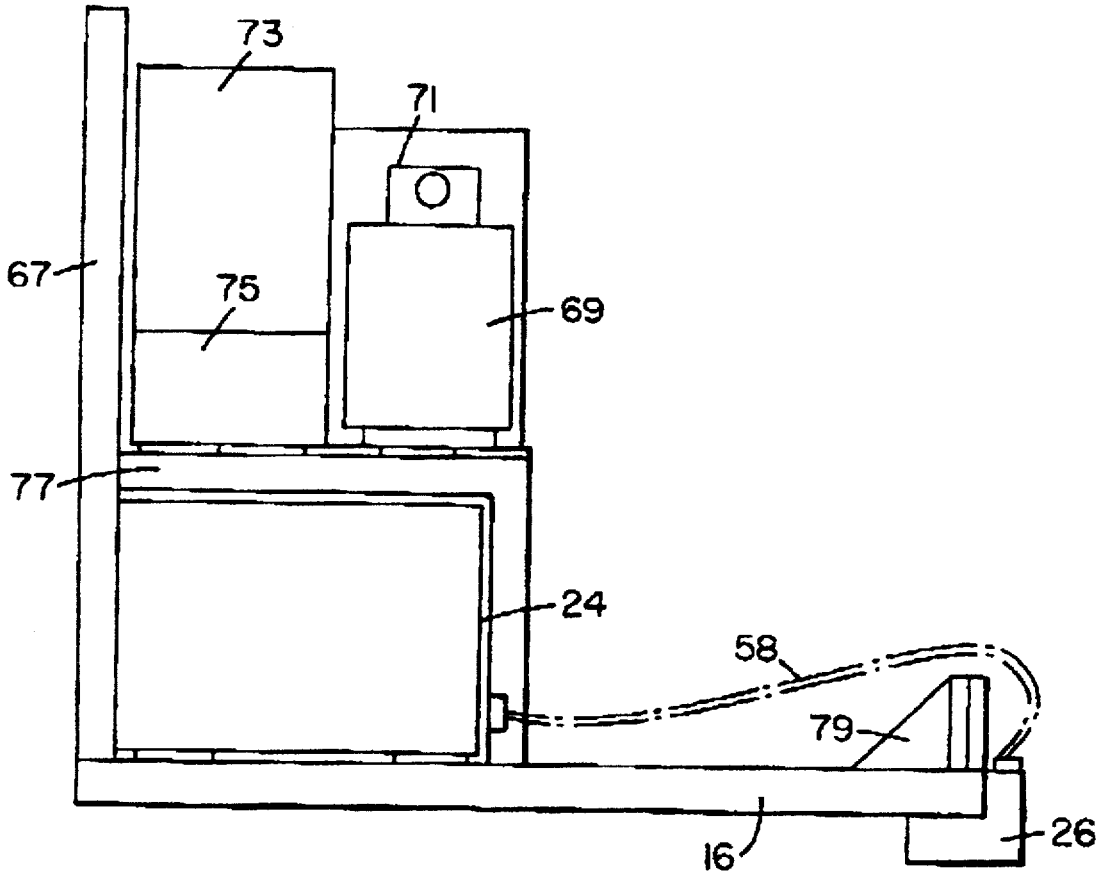
FIG. 5 is a schematic side view of the device as in FIG. 1 showing an embodiment of a general arrangement of the components with typical dimensions.

Referring to FIG. 5, the power means or generator 24 is positioned on said rear section 20 of said platform means 16 and in a preferred embodiment comprises a gas, e.g., propane operated D.C. generator fueled by propane tank 69 and having an output of at least about 2.5 kw at 20 amps. Power is rectified in 73 and conducted thru lines 58 and switch means 28 from power means 24 to the magnets.

Other types of self-contained D.C. power generators may, of course, be used including gasoline powered units, and may be provided with battery storage capacity as in battery means 75. Typical of such gasoline or gas fueled generators useful for the present invention is the "MicroLite™ 2800 GenSet" generator shown and described in the *ONAN CORPORATION*, 10/92 catalog A-994H, the disclosures and descriptions of which are hereby incorporated herein by reference in their entirety.

The CDS controllers 71 useful for the present invention for rectifying and reverse polarization switching are typified by the controllers shown and described in the *O.S. WALKER*, Jan. 9, 1995, page entitled "Electromagnetic Chuck Controls Price List", the disclosures and descriptions of which are hereby incorporated herein by reference in their entirety.

The platform means 16 is preferably provided with steel beam backstops 67 for preventing tipping of the heavy equipment which is stacked on shelf means such as 77. The components of 16 may be rigidified by gussets such as 79.

Figure 3:
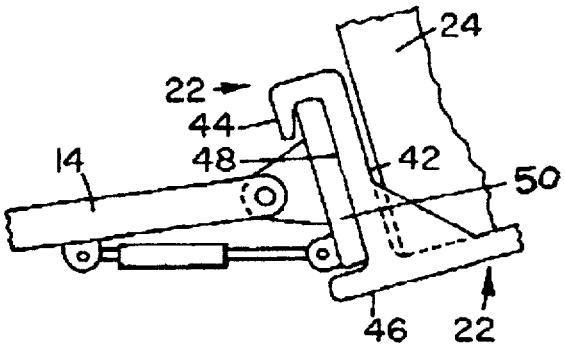
FIG. 3 is a side view of the lift mechanism of a skidsteer vehicle with the present device mounted on the front connector plate thereof.
Figure 4:
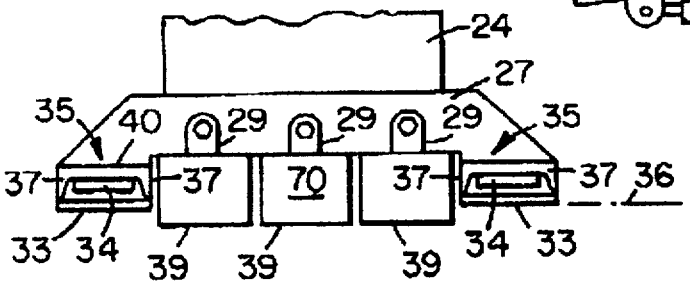
FIG. 4 is a front view of the device of FIG. 1 taken in the direction of arrow "4" of FIG. 1.

In the embodiment of FIG. 3 the adaptor means 22 comprises a simple bracket 41 having a front section 42, a top hook section 44, and a bottom section 46 to provide a cavity generally designated 48 into which the connector plate 50 of a skidsteer, or a bulldozer blade or the like can be maneuvered. It is noted that the weight of the present device will retain hook section 44 firmly down on the aforesaid plate or blade. In this regard, the exact shape and dimensions of said bracket and cavity are readily tailored to fit any particular configured lifting means.

Figure 6:
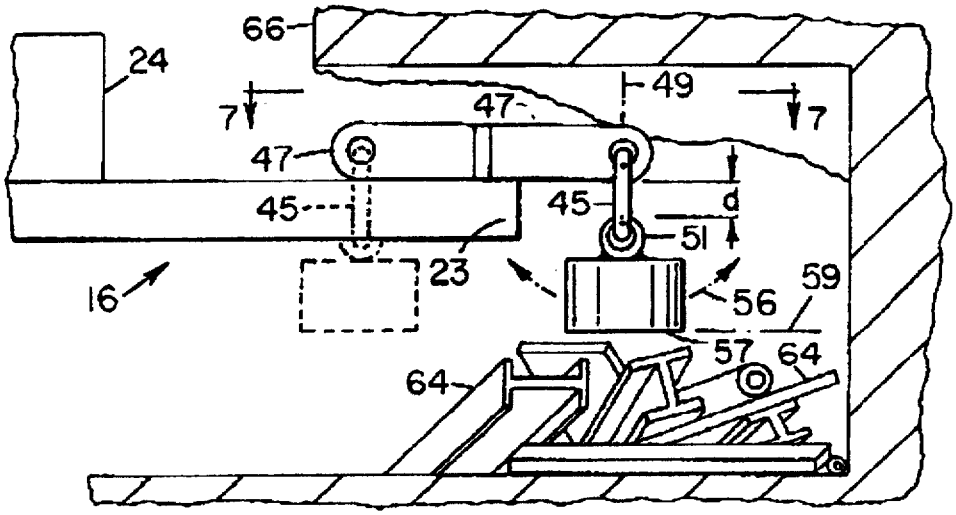
FIG. 6 is a side cross-sectional view of a metal work table or loading dock facility showing the ease of extension of the pick-up magnets thereunder in a position to selectively or enmass retrieve heavy metal pieces from a jumbled pile.
Figure 11:
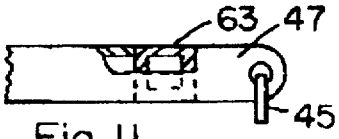
FIG. 11 is a partially cross-sectioned side view of variations of the forward section of the platform means which affixes to the pivotal mounting means.
Figure 12:
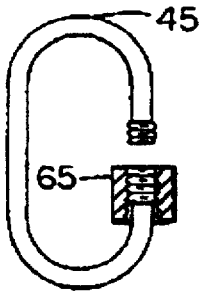
FIG. 12 is a partially cross-sectioned view of a preferred linking means of the mounting means.

Referring further to the drawings, in FIG. 6 a pile of workpieces 64 are shown under a table, loading dock 66, or the like, and wherein the platform 16 and second component 47 of the mounting means gives an unencumbered reach to the magnets of, e.g., about 3 or 4 feet such that the workpieces can easily be reached. Component 47 is preferably welded to the top of end 23 of the platform and stabilizing by side gussets 72 welded in place. As shown in FIG. 11, component 47 may be welded to a cross-bar 63 forming the distal end of the platform means.

The extension beyond distal end 23 of the platform afforded by component 47 allows a free swinging action of the magnet thru the large arc 56 as indicated by the dotted line in FIG. 6. The vertical and pivotal motion or freedom of motion of the magnets about axis 49 as shown by arrows 68 in FIG. 7 is provided by the loose fittings between said first, second and third components of the mounting means. These pivotal and swinging action capabilities provide for a substantially universal mobility of the magnets.

Figure 10:
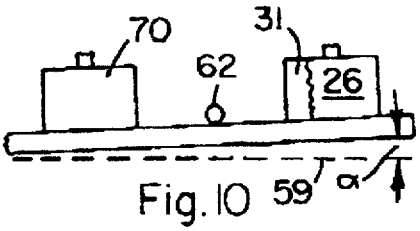
FIG. 10 is a side view of the device taken in the direction of line 10 in FIG. 7 showing the third magnet in its triannular location, wherein the three magnets are shown slightly tilted within the tilt plane and magnetically affixed to a heavy, large steel plate.

As shown in FIGS. 7 and 10, a third electromagnet 70 may be provided, and preferably is mounted on the inner end 74 of a second component 76 of the mounting means 29, equivalent to 47 to give a triangular configuration shown, e.g., by dotted lines 78, of the magnets. Such a configuration is highly desirable, as shown in FIG. 10, for picking up large sheets which would otherwise tend to tip about axis 62 to an unmanageable degree. As shown in FIG. 10, the present triangular configuration allows tipping of such a workpiece only within the aforesaid angle range α, whereby the workpiece can be managed easily and transported, rather than being dragged along the floor.

Figure 8:
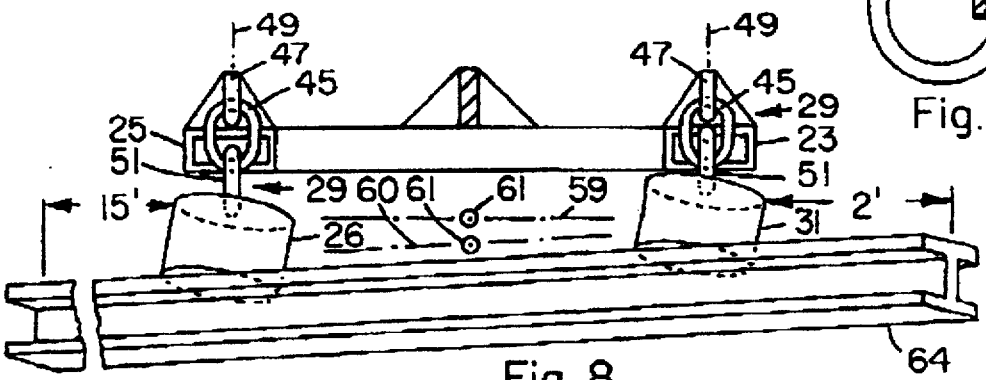
FIG. 8 is an isometric view of a two magnet embodiment showing how a long, heavy unbalanced beam is suspended within the confines of the present workpiece tilt plane.
Figure 16:
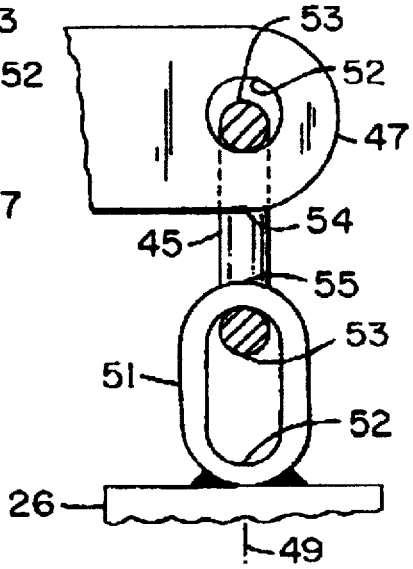
Figure 9:
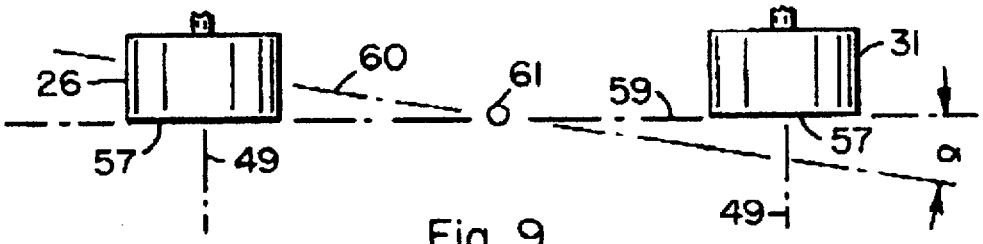
FIG. 9 is an end view of the magnets of FIG. 8 in an at rest or free hanging posture and showing various axes and planes by dotted lines.

Referring to the embodiment of FIG. 8, the first component 45 and third component 51 are elongated as shown in FIG. 16 whereby the second stop means 55 of said third component abuts the first stop means 54 on second component 47 and prevents the elongated beam 64 from tilting onto the floor even though as shown, the right hand end of the beam may be 2 feet long while the left hand end may be 15 feet long and weigh a ton. The present mounting structure and the said at least two electromagnets thus makes it possible to easily pick up heavy, elongated workpieces without having to maneuver the fork lift into a position, which may be virtually impossible, whereby the workpiece is substantially centered such as is required in using single suspended magnets in order to prevent dragging the workpiece along the floor or ground.

Figure 13:
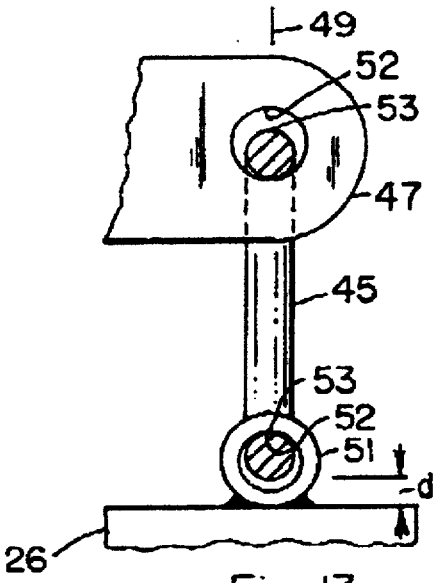
FIGS. 13 thru 16 are side views, partially cross-sectioned, of the pivotal mounting means showing how the various stop means function to provide a tilt plane for a workpiece, where such is necessary.
Figure 14:
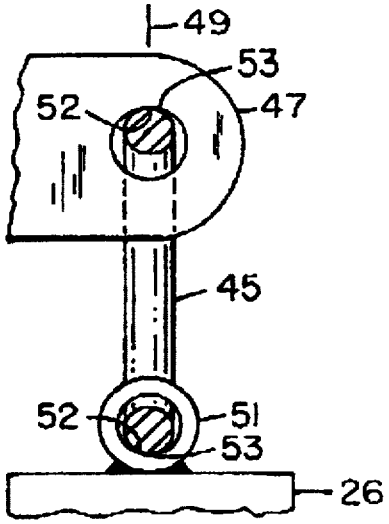
Figure 15:
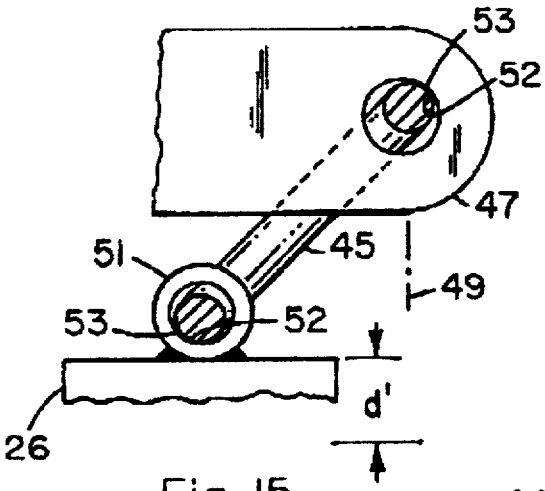

In FIGS. 13–15, the aforesaid components and stop means are constructed to provide a more limited vertical movement of the magnet as indicated by "d" in FIG. 13. In situations where the magnets slide along the workpiece in finding their most stable and efficient positions prior to their being energized, the positions of the magnets with respect to their axes 49 may be translated as shown in FIG. 15. The actual upward or vertical distance therefore that the magnets move as they swing thru arc 56 may be designated $d^1$ which is substantially greater than d, however, the aforesaid components and stops are preferably configured and dimensioned to keep the tilt plane of the workpiece within the angle α. Preferably, the vertical movement range is from about ½" to about 2", but less or greater movements are operable depending on the characteristics of the workpiece.

The invention has been described in detail with particular reference to preferred embodiments thereof, but it will be understood that variations and modifications will be effected within the spirit and scope of the invention.

I claim:

1. A self-contained electromagnetic pick-up device for use particularly with a vehicle having power lifting means, said device comprising platform means for supporting electrical and mechanical components of said device, said platform means having a forward section, a rear section, and a pair of opposing side portions each of which has a proximal end adjacent said rear section and a distal end adjacent said forward section adaptor means on said rear section for engaging and being supported by said lifting means for being moved thru a lifting cycle thereby, electrical power means on said platform means, at least two separate electromagnet means on said platform means, and electrical switch means adapted to electrically connect or disconnect said power means from said electromagnet means whereby an operator can selectively control the energization of said electromagnet means, wherein at least two of said electromagnet means is mounted on said platform means by separate pivotal mounting means, each said mounting means having first component means affixed at the distal end of a said side portion and second component means affixed to an electromagnet means and providing generally universal pivot freedom and swing freedom to said electromagnet means, wherein each said mounting means and its associated electromagnet means has a substantially coextensive and substantially vertical rest axis passing thru said first and second component means, wherein cooperating first and second stop means are provided on said first and second component means respectively and spaced apart along said axis and extending generally laterally of said axis, whereby in use, one of said at least two electromagnet means can assume a position elevated a short vertical distance higher than the other said at least two electromagnet means to accommodate a limited workpiece tilt plane, and wherein at least a major portion of each said at least two electromagnet means lies beyond the distal end of its associated side portion and is substantially unencumbered in its pivot and swing freedom by any portion of said platform means.

2. The device of claim 1 wherein said adaptor means comprises a pair of elongated tubular members each being configured and dimensioned in cross-section for slidably receiving a tine of a forklift truck.

3. The device of claim 1 wherein said electromagnet means comprises one or more 115 volt D.C. electromagnets affixed to said forward section with their armature faces extending below the plane of said section.

4. The device of claim 1 wherein said switch means is provided with quick-disconnect means for providing for positioning said switch means within or adjacent to the operators compartment of a vehicle and for easy removal thereof from said compartment upon release of said pick-up device from said lifting means.

5. The device of claim 1 wherein said power means is positioned on said rear section of said platform means.

6. The device of claim 1 wherein said power means comprises a power means substantially comprises a 2.5 kw, 20 amp, propane fuel operated D.C. generator.

7. The device of claim 1 wherein said first and second stop means of said at least two electromagnet means are vertically spaced apart from about one to about three inches, and said pivotal mounting means for said at least two electromagnet means are spaced apart from about 2.5 to about 4.5 feet whereby a workpiece first tilt plane of up to about 35 degrees is accommodated.

8. The device of claim 7 wherein a third electromagnet means is supported by a said mounting means and positioned between said two electromagnet means and rearwardly thereof to form a triangular pattern for the three electromagnetic means and establish a workpiece second tilt plane having a rotational axis oriented substantially normal to the rotational axis of said first tilt plane.

9. The device of claim 1 wherein said first component means comprises a single link, and wherein each said at least two electromagnet means is positioned outwardly of the forward end of said platform means and substantially below the bottom of said forward end.

10. The device of claim 1 wherein a third electromagnet means is supported by a said mounting means and positioned substantially in line with and between said two electromagnet means.

* * * * *